United States Patent [19]

Reynolds, Jr.

[11] Patent Number: 4,777,754

[45] Date of Patent: Oct. 18, 1988

[54] LIGHT BEAM ASSISTED AIMING OF FIREARMS

[75] Inventor: Edward C. Reynolds, Jr., Anaheim, Calif.

[73] Assignee: Laser Products Corporation, Fountain Valley, Calif.

[21] Appl. No.: 941,307

[22] Filed: Dec. 12, 1986

[51] Int. Cl.[4] ..... F41G 1/34

[52] U.S. Cl. ..... 42/103; 362/110

[58] Field of Search ..... 42/103, 1.01, 84; 362/110, 111, 112, 113, 114

[56] References Cited

U.S. PATENT DOCUMENTS

| | | | |
|---|---|---|---|
| 689,547 | 12/1901 | James | 42/103 |
| 894,306 | 7/1908 | Wright | 42/103 |
| 1,120,769 | 12/1914 | Villarejo | 362/114 |
| 1,149,705 | 8/1915 | Ward | 42/103 |
| 1,262,270 | 4/1918 | Schmidt et al. | 362/110 |
| 1,263,667 | 4/1918 | Henderson et al. | 362/114 |
| 1,338,239 | 4/1920 | Matys | 362/114 |
| 1,427,042 | 8/1922 | Wetmore | 362/114 |
| 1,452,651 | 4/1923 | Norrlin | 375/1 |
| 1,826,004 | 10/1931 | Key | 42/103 |
| 1,993,979 | 3/1935 | Reed | 362/113 |
| 2,017,585 | 10/1935 | Casey | 362/114 |
| 2,085,732 | 7/1937 | Baxter et al. | 362/114 |
| 2,209,524 | 7/1940 | Key | 42/103 |
| 2,314,061 | 3/1943 | Whaley | 42/103 |
| 2,450,584 | 10/1948 | Dodge | 362/114 |
| 2,597,565 | 5/1952 | Chandler et al. | 362/112 |
| 2,844,710 | 7/1958 | Zinsser | 42/103 |
| 2,912,566 | 11/1959 | Cornett | 362/113 |
| 3,010,019 | 11/1961 | Sohst | 356/247 |
| 3,104,478 | 12/1960 | Strauss et al. | 434/22 |
| 3,222,251 | 12/1965 | Breeding | 362/110 |
| 3,243,896 | 4/1966 | Immarco et al. | 434/22 |
| 3,294,401 | 12/1966 | Nicholas et al. | 362/113 |
| 3,447,033 | 5/1969 | Redmond et al. | 434/22 |
| 3,513,581 | 6/1968 | Slater | 42/103 |
| 3,633,285 | 1/1972 | Sensney | 42/103 |
| 3,739,167 | 6/1973 | Avery | 42/103 |
| 3,782,832 | 1/1974 | Hacskaylo | 356/153 |
| 3,834,052 | 9/1974 | Steck, III | 42/103 |
| 3,867,764 | 2/1975 | Dunmire et al. | 33/241 |
| 3,898,747 | 8/1975 | Marshall | 42/103 |
| 3,938,262 | 2/1976 | Dye et al. | 434/22 |
| 3,974,585 | 8/1976 | Dunham | 42/103 |
| 3,995,376 | 12/1976 | Kimble et al. | 434/22 |
| 4,026,054 | 5/1977 | Snyder | 42/103 |
| 4,044,486 | 8/1977 | Van Holten | 42/103 |
| 4,079,534 | 3/1978 | Snyder | 42/103 |
| 4,152,754 | 5/1979 | de Filippis et al. | 362/113 |
| 4,161,076 | 7/1979 | Snyder | 42/103 |
| 4,168,588 | 9/1979 | Snyder | 42/103 |
| 4,212,109 | 7/1980 | Snyder | 42/103 |
| 4,313,272 | 2/1982 | Matthews | 42/103 |
| 4,313,273 | 2/1982 | Mathews et al. | 42/103 |
| 4,418,487 | 12/1983 | Strahan | 42/103 |
| 4,542,447 | 9/1985 | Quakenbush | 42/103 |
| 4,627,183 | 12/1986 | Stuckman | 362/110 |

FOREIGN PATENT DOCUMENTS

| | | | |
|---|---|---|---|
| 1926337 | 11/1970 | Fed. Rep. of Germany . | |
| 652692 | 3/1929 | France | 42/1.01 |
| 694560 | 9/1930 | France | 362/110 |
| 1015421 | 9/1952 | France . | |
| 29708 | 11/1903 | Switzerland . | |
| 66753 | 12/1913 | Switzerland . | |
| 5029 | of 1913 | United Kingdom | 362/114 |

OTHER PUBLICATIONS

Wm. F. Krentz, "Scope Your Handgun for Higher Scores", The American Rifleman, pp. 34–35, Jun. 1974.

*Primary Examiner*—Deborah L. Kyle
*Assistant Examiner*—Michael J. Carone
*Attorney, Agent, or Firm*—Benoit Law Corporation

[57] ABSTRACT

An aim assistance light beam for a firearm having functional parts necessary for the operation of that firearm as a firearm is provided by adaption of a battery housing to a contour of that firearm below a barrel and ahead of a trigger guard thereof as seen in a direction of the light beam, for reception of an electric battery remotely from a stock of the firearm. A common fastener is provided for that battery housing as well as for one of the necesary functional parts of the firearm, and both that battery housing and that one necessary functional part are attached with that common fastener to the firearm. A light source is mounted on that battery housing for providing an aim assistance light beam upon energization from the battery through an electric on-off switch provided independently of any trigger and hammer assembly of the firearm.

25 Claims, 5 Drawing Sheets

LIGHT BEAM ASSISTED AIMING OF FIREARMS

BACKGROUND OF THE INVENTION

1. Field of the Invention

The subject invention relates to firearms and, more specifically, to methods and apparatus for assisting the aiming of firearms, and in particular to methods and apparatus for assisting the aiming of firearms with a light beam.

2. Disclosure Statement

This disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material. though not necessarily being of itself pertinent. Also, the following comments contain conclusions and observations which have only been drawn or become apparent after conception of the subject invention or which contrast the subject invention or its merits against the background of developments which may be subsequent in time or priority.

For over eighty years, proposals have been made for assisting the aiming of firearms with light beams or light spots on targets. Reference may, for instance, be had to U.S. Pat. Nos. 689,547, 894,306, 1,149,705, 1,452,651, 1,826,004, 1,993,979, 2,017,585, 2,844,710 and 2,912,566, proposing clampling a flashlight or incandescent lamp with lens, reflector arrangement and on-off switch or trigger switch and external or internal battery to a handgun, and U.S. Pat. Nos. 3,010,019 and 3,974,585, British Pat. No. 5029, Swiss Pat. Nos. 29,708 and 66,753, French Pat. No. 1,015,421, and German Patent Publication No. 1,926,337, which also propose employment of electric incandescent lamps for providing aiming marks on firearm targets or on an optical sight.

Further proposals were spawned by the development of laser diodes comparable in size and ruggedness to small incandescent light bulbs as may be seen from U.S. Pat. No. 3,867,764. The utility of laser diodes as aiming devices was, however, generally limited to marksmanship trainer, boresight alignment, weapon simulator and similar applications, as may, for instance, be seen from U.S. Pat. Nos. 3,633,285, 3,782,832, 3,898,747, 3,938,262 and 3,995,376. An infrared-light hit indicator apparatus is apparent from U.S. Pat. No. 3,104,478, and an electronic target game from U.S. Pat. No. 3,294,401.

The success of gas discharge lasers spawned proposals to use that type of laser in weapon aiming systems, as apparent from U.S. Pat. Nos. 4,026,054, 4,079,534, 4,152,754, 4,161,076, 4,168,588 and 4,212,109. Laser weapon simulators have been disclosed in U.S. Pat. Nos. 3,243,896 and 3,447,033.

Further references include U.S. Pat. Nos. 1,427,042, 2,085,732 and 2,597,565 disclosing methods of completing the electric circuit when the flashlight element is added, U.S. Pat. No. 2,209,524 showing flashlight holders engaging a recess in a flashlight body or providing a transverse pin between spaced pistol grip bars for flashlight mounting purposes, U.S. Pat. No. 2,314,061 disclosing a tongue-type flashlight mounting, U.S. Pat. No. 2,450,584 for flashlight attachment for small arms, U.S. Pat. Nos. 3,222,511 and 4,542,447 showing dual switching means and mounting systems for flashlights on firearms, and U.S. Pat. No. 3,739,167 disclosing also remote switching means for firearm-mounted lighting units.

Advanced laser beam aim assistance systems have been disclosed in U.S. Pat. Nos. 4,313,272 and 273 issued to the subject common assignee. While these systems perform excellently, they naturally are rather expensive and therefore beyond the reach of many police departments or citizens.

SUMMARY OF THE INVENTION

It is a general object of this invention to overcome disadvantages and satisfy needs expressed or implicit in the above Information Disclosure Statement or in other parts hereof.

It is a germane object of this invention to provide improved aiming systems for firearms of relatively moderate cost.

It is a related object of this invention to provide improved methods and apparatus for assisting the aiming of a firearm with a light beam from a flashlight.

It is a germane object of this invention to provide improved aim assistance and target illumination systems which do not require modification of the weapon itself.

It is also an object of this invention to provide improved light mounting systems and structures.

It is also a germane object of this invention to provide improved light mounting systems and structures employing a fastener common to an electric battery housing and to a necessary functional part of the firearm.

It is a related object of this invention to provide improved light mounting systems and structures wherein a battery housing is in the form of a hand grip for manual actuation of a fore-end assembly of the firearm.

Other objects will become apparent in the further course of this disclosure.

From a first aspect thereof, the subject invention resides in apparatus including a flashlight for throwing a light beam assisting the aiming of a firearm having a barrel, stock, trigger, trigger guard and hammer assembly. The invention according to this aspect resides, more specifically, in the improvement comprising, in combination, a lamp and reflector assembly for throwing the light beam upon electric energization of the lamp, a battery housing having a contour adapted to a contour of the firearm below the barrel for mounting the light and reflector assembly below the barrel ahead of the trigger guard as seen in a direction of the light beam, an electric circuit for selectively energizing the lamp from an electric battery, including an electric on-off switch independent of the trigger and hammer assembly, means in the battery housing for receiving the electric battery remotely from the stock and for providing electric energization of the lamp upon closure of the switch, means for manual actuation of that switch including a manually engageable switch actuator spaced away from the trigger and, means for mounting the battery housing on the firearm below the barrel, including a fastener common to the battery housing and to a functional part necessary for the operation of the firearm as a firearm.

This combination may include one or more of the following features:

The battery housing includes a rear end remote from the lamp assembly and contoured into conformity to an adjacent portion of the trigger guard spaced away from the trigger.

The battery housing includes a lamp housing containing the lamp and reflector assembly and being releasably mounted on the battery housing for receiving a part of the electric battery protruding from that battery housing.

Means for manual actuation of the switch include a manually engageable switch actuator spaced away from the trigger and including a manually engageable slide element substantially flush with an outside surface of the battery housing at one side of the battery housing.

Means for mounting the battery housing include a housing mount extending to the location of the necessary functional part above the trigger guard so that both the battery housing at the housing mount and the one necessary functional part are attachable to the firearm with the common fastener.

A lamp and reflector assembly for throwing the light beam upon electric energization of the lamp include means for providing a prefocused beam giving a bright central spot for aiming the firearm, and a lower light level beam for general illumination of a target.

The necessary functional part and the fastener are in one piece.

The fastener includes means for coupling the necessary functional part to another functional part necessary for the operation of the firearm.

From a related aspect thereof, the invention resides in apparatus including a flashlight for throwing a light beam assisting the aiming of a firearm having a movable fore-end assembly for loading shells and actuating a firearm action. The invention according to this aspect resides, more specifically in the improvement comprising, in combination, a lamp and reflector assembly for throwing the light beam upon electric energization of the lamp, a battery housing for mounting the light and reflector assembly below the barrel ahead of the trigger guard as seen in a direction of the light beam, that battery housing being in the form of a hand grip for manual actuation of the fore-end assembly, means for mounting the battery housing in said form to the fore-end assembly for said manual actuation of the fore-end assembly with the battery housing, an electric circuit for electrically energizing the lamp from an electric battery including an electric on-off switch, and means in the battery housing for receiving the electric battery remotely from the stock and for providing electric energization of the lamp upon closure of the switch.

From a related aspect thereof, the invention resides in a method of providing an aim assistance light beam for a firearm having functional parts necessary for the operation of said firearm as a firearm, and, more specifically, resides in the improvement comprising in combination the steps of adapting a battery housing to a contour of the firearm below a barrel and ahead of a trigger guard thereof as seen in a direction of the light beam, for reception of an electric battery remotely from a stock of the firearm, providing a common fastener for the battery housing as well as for one of said necessary functional parts of the firearm, attaching with that common fastener both the battery housing at said contour and said one necessary functional part to the firearm, and mounting on that battery housing a light source for providing the aim assistance light beam upon energization from the battery through an electric on-off switch provided independently of any trigger and hammer assembly of the firearm.

The combination according to this aspect of the invention may include one or more of the following features:

The on-off switch is mounted on the battery housing at the trigger guard and spaced away from the trigger.

There is provided with the light source a prefocused beam giving a bright central spot for aiming the firearm, and a lower light level beam for general illumination of a target.

The one of the necessary functional parts is situated above the trigger guard, and the battery housing is provided with an extension reaching that necessary functional part so that both the battery housing at the extension and the one necessary functional part are attachable to the firearm with the common fastener.

The necessary functionals parts include a slide and a slide stop necessary for selectively arresting and releasing that slide, and both the battery housing at the mentioned contour and the slide stop are attached to the firearm with the common fastener.

The fastener and the one necessary functional part are made in one piece.

The one necessary functional part is coupled thorugh the fastener to another of the functional parts necessary for the operation of the firearm.

Both the battery housing at the mentioned contour and the one necessary functional part are attached to the firearm with the fastener coupling that one necessary functional part to the other functional part necessary for the operation of the firearm.

From a related aspect thereof, the invention resides in a method of providing an aim assistance light beam for a firearm having a movable fore-end assembly for loading shells and actuating a firearm action, and, more specifically, resides in the improvement comprising in combination the steps of shaping and constituting a battery housing as a hand grip for manual actuation of the fore-end assembly and for reception of an electric battery remotely from a stock of the firearm, and mounting on that battery housing a light source for providing the aim assistance light beam upon energization from the battery through an electric on-off switch provided independently of any trigger and hammer assembly of the firearm.

BRIEF DESCRIPTION OF THE DRAWINGS

The invention and its various objects and aspects will become more readily apparent from the following detailed description of preferred embodiments thereof, illustrated by way of example in the accompanying drawings, in which like reference numerals designate like of equivalent parts, and in which.

DESCRIPTION OF PREFERRED EMBODIMENTS

Figure 1:
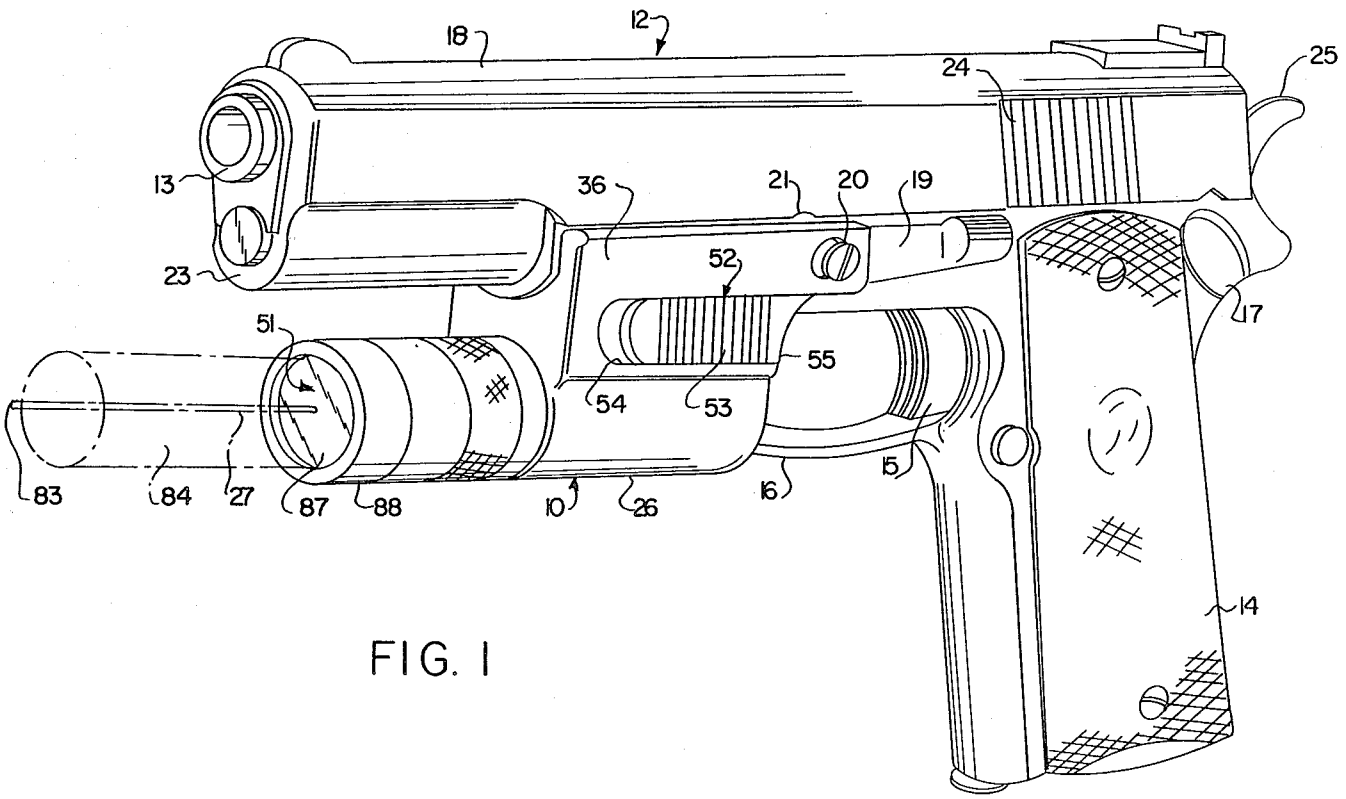
FIG. 1 is a perspective view of a firearm with apparatus for assisting the aiming thereof according to a preferred embodiment of the subject invention.

FIG. 1 shows the illumination and aim assistance apparatus 10 according to one of the illustrated preferred embodiments of the subject invention mounted on a firearm 12 in the form of a Caliber .45 Automatic Colt handgun. That handgun has conventional parts and components, including a barrel 13, a stock or handgrip 14, a trigger 15, a trigger guard 16, a safety 17, a slide 18, a modified slide stop 19, and a slide stop fastener or shoulder screw 20.

It is of significance to the currently discussed aspect of the subject invention that the shoulder screw 20 is a fastener provided for releasably retaining a part 19 of the firearm which is necessary for the operation of that firearm 12 as a firearm, as distinguished from an aim assistance device 10. In this respect, it is well known that the slide 18 can be moved relative to the firearm receiver or frame 23.

Fingergrips, one of which is seen at 24, are provided for enabling the user to withdraw the slide 18 manually for actuation of a firearm action, loading or ejection of shells, and the like. The slide 18 moves backward, as seen in FIG. 1, against the operation of a spring (see 323 in FIG. 7) which returns the slide to its illustrated position after it has performed its intended function.

As its name implies, the slide stop 19 may be employed for inactivating or stopping the slide 18 in an extended position. A projection of the slide stop may engage a corresponding notch 21 in the slide for that purpose. The slide stop 19 may functionally be tied in with the safetY 17 as well known for inhibiting an unwanted discharge or other malfunction of the firearm. A hammer 25 is located at the rear of the firearm, remotely from the apparatus 10.

The slide stop 19 is an example of a latch necessary to the operation of the firearm 12 as a firearm. The expression "operation" in this respect is intended to be sufficiently broad to cover what is necessary to make the firearm functional or to make it safe, apart from the emission of any aim assistance light beam.

The aim assistance apparatus 10 includes a battery housing 26 which, according to the currently discussed aspect of the subject invention, is adapted to a contour of the firearm below the barrel 13 or frame 23 and ahead of the trigger guard 16 thereof as seen in a direction of the light beam 27, for reception of an electric battery 28 remotely from the stock of the firearm 14. In this manner, the previously frequently necessary modification of the firearm at the stock or handgrip 14 and the need for an electric conduit therefrom are avoided in the practice of the subject invention.

Figure 4:
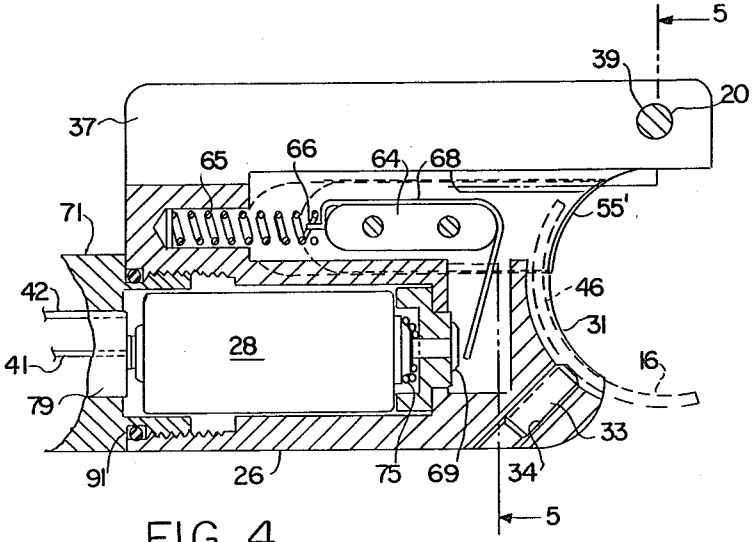
FIG. 4 is a section taken on the line 4—4 in FIG. 3.

As shown particularly at 31 in FIG. 4, the rear contour of the battery housing is in conformity with the curved front portion of the trigger guard 16, whereby the aim assistance apparatus 10 in effect forms a structural and functional unit with the firearm 12. A set screw 33 is threaded into an internally threaded hole 34 in the back of the battery housing 26. An Allen wrench or other tool may be inserted into the hole 34 to tighten the set screw against the trigger guard 16, thereby stabilizing the attached aim assistance apparatus 10 on the firearm.

In that respect, the shoulder screw for mounting the firearm latch or slide stop 19 is used as common fastener for the battery housing 26, as well as for that necessary functional part 19 of the firearm. This is an important feature of the currently discussed aspect of the subject invention.

Usually, the shoulder screw 20 provided for the slide stop 19 of the firearm will be found satisfactory for attaching the battery housing 26 as well. However, even where a longer or otherwise modified screw 20 is desirable or necessary for attaching both the firearm latch 19 and the battery housing 26, that special screw or other fastener still is the common fastener within the scope of the currently discussed aspect of the invention for attaching both the battery housing 26 and the necessary functional part 19 of the firearm 12 to the frame 23 of the firearm or otherwise to the firearm proper.

The battery housing has two elongate upward projections or uprights 36 and 37 for straddling the lower portion or frame 23 of the firearm thereby following at least in part its contour. In this manner, the battery housing has a housing mount 36, 37 contoured into conformity with a lower portion 23 of the firearm below the barrel 13.

Where the above mentioned necessary functional part 19 of the firearm is situated above the trigger guard 16, the battery housing is provided with an extension, such as the uprights 36 and 37 reaching that necessary functional part so that both the battery housing at that extension and that one necessary functional part are attachable to the firearm with the common fastener 20.

The upright 36 may have an inside recess for receiving and accommodating part of the latch or slide stop 19. The fastener or bolt 20 common to the latch 19 and battery housing 26 extends from the upright 36 through a bore 44 in the firearm to the upright 37, where it is threaded into an internally threaded bore or aperture 39 as shown in FIGS. 2 to 5.

In many cases, that type of common fastener 20 is the only means necessary for attaching the aim assistance apparatus 10 to the firearm. Other fasteners, may also be employed for that purpose, but would only be secondary to the common fastener 20, which then still would be the primary means of attaching the unit 10 to the firearm.

Figure 5:
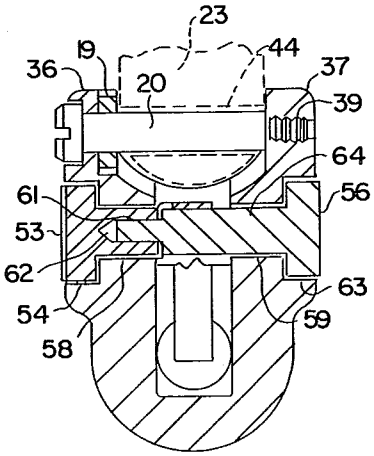
FIG. 5 is a section taken on the line 5—5 in FIG. 4.
Figure 3:
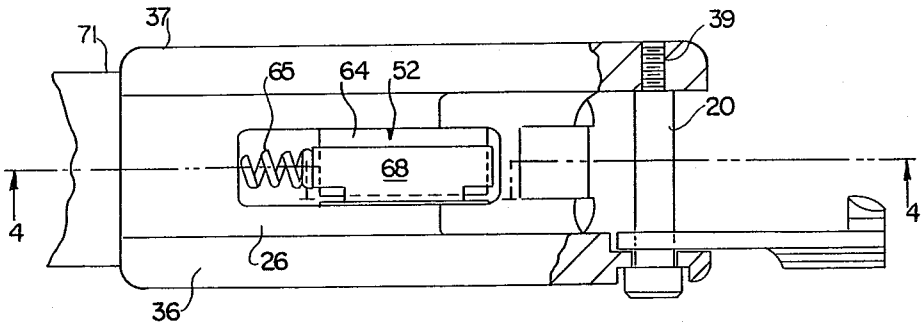
FIG. 3 is a top view of the apparatus shown in FIGS. 1 and 2.

An important feature of the currently discussed aspect of the invention is that no gunsmithing is required for attaching the aim assistance apparatus 10 to the firearm and for securely maintaining the same thereon. Most importantly, since a fastener of the type of bolt 20 is at any rate required for attaching an essential part 19 to the firearm, there is already present on the firearm a hole or bore when the firearm is sold or distributed to the user without the aim assistance apparatus 10. By way of example, FIG. 5 shows such a bore in dotted lines at 44, but it should be understood that the principle of the subject invention applies also to other holes and to other common fasteners by means of which the unit 10 may be attached or retrofitted to the firearm without the need for drilling any special holes or carrying out any gunsmithing for an attachment of the unit 10.

A positioning screw 33, which may be provided for stabilizing the unit 10 on the firearm, is only a set screw which abutsadjacent portions of the firearm without penetrating the same. In this respect, the rear end 31 of the battery housing 26 may also have a curved groove 46 for receiving and accomnodating the adjacent front portion of the trigger guard 16. This is important in practice, where a projecting foreign object at the trigger finger may annoy or even frustrate the marksman.

Even though the subject invention attaches the aim assistance apparatus to the firearm without any locksmithing and similar operation, the apparatus 10 is, nevertheless, very securely attached to the firearm, so that firearm 18 and apparatus 10 in effect present one integral unit.

The subject invention also mounts on the battery housing 26 a light source 51 for providing the aim assistance light beam 27 upon energization from the battery 28 through an electric on-off switch 52 provided independently of any trigger and hammer assembly of the firearm. This also distinguishes the subject invention favorably from prior-art approaches which have placed foreign objects in the form of electric switches at sensitive parts of the firearm, such as triggers, where the marksman does not want to be disturbed by any foreign object.

Accordingly, the preferred embodiment of the invention shown in FIGS. 1 to 5 mounts the on-off switch 52 on the battery housing 26 at the trigger guard 16 away from the trigger 15.

The electric switch 52 includes a manually actuable switch actuator 53 spaced away from the trigger 15. In the illustrated preferred embodiment of FIGS. 1 to 5, that switch actuator 53 is in the form of a manually engageable slide element substantially flush with an outside surface of the battery housing at one side of that battery housing 26. An elongate recess 54 is provided in that one side of the battery housing for accommodating the switch actuator or slide element 53, which has a rear end 55 contoured into conformity with the rear end 31 of the battery housing, as well as with the adacent portion of the trigger guard 16 (see also 55' in FIG.4). To enable a showing in FIG. 2 of elements 61 and 62 of the fastening facility mentioned in the next paragraph, the showing of such elements is reversed in FIG. 2 relative to FIG. 5.

In the preferred embodiment shown in FIGS. 1 to 5, the switch includes a corresponding further manually engageable switch actuator 56 which is interconnected with the actuator 53 through elongate apertures 58 and 59 and by interfitting complementary fastening facilities 61 and 62. Of course, the recess 54, which accommodates the actuator 53, the recess 63, which accommodates the actuator 56, and the apertures 58 and 59 are sufficiently elongated to enable manual actuation of the electric switch 52 by sliding movement of the actuators 53 and 56.

In this manner, the electric switch 52 may be activated by left-handed users, as well as by right-handed users, of the firearm. The marksman does conveniently actuate the switch 52 with a particular finger or thumb of the hand which holds the grip 14 and pulls the trigger 15. Alternatively, where the marksman uses both hands for holding the firearm, such as in an overgrip engagement, he or she may use one hand for holding the grip 14 and pulling the trigger 15, and the other hand for actuating the switch 52. Very accurate marksmanship is thus possible.

Both actuators 53 and 56 preferably are essentially flush with opposite sides of the battery housing 26 or its extensions 36 and 37, so that no part of the switch 52 interferes with the normal operation of the firearm.

The electric switch 52 is a slide switch including a slide 64 which may be integral with the manually engageable switch actuator 56 to which actuator 53 is attached. The slide 64 may thus be manually pushed forward against the bias of a spring 65 via either manually engaged actuator 53 or 56. The slide 64 or spring 68 retain the helical spring 65 with a projection 66. A detent arrangement may be provided for retaining the switch 52 in an actuated position, if desired.

The switch slide 64 carries a bent leaf spring 68 which has a rest position spaced from a corresponding switch contact 69. The spring 65 thus biases the electric on-off switch 52 to its off position so that the energization of the lamp or light source 51 only persists as long as either switch actuator 53 or 56 is manually engaged in an on position or is held therein.

In addition to the battery housing 26, the means for receiving the electric battery 28 include a lamp housing 71 containing a lamp 72 and reflector assembly 73 and being threaded or otherwise releasably mounted electric battery 28 protruding from the battery housing 26. In other words, the lamp housing 71 is shaped for receiving a part of the electric battery 28 protruding from the battery housing 26.

A spring assembly 75 connects one side, such as the negative pole, to the switch contact 69. Similarly, a contact assembly 41, 42, 79, seen in FIG. 4, connects the other side of the battery 28, such as its positive pole, to one terminal 77 of the lamp 72 through a contact 41 extending into the lamp base 78. The other terminal 81 of the lamp 72 is connected to ground via a contact assembly 42; ground in that case being the metallic mass of the lamp housing 71 and battery housing 26. Accordingly, when the slide switch 52 is pushed so that the leaf spring 68 engages the switch contact 69, the lamp 72 is energized from the battery 28 through an electric circuit including the front portion or positive pole of the battery, the spring assembly 75, contact 41, first lamp terminal 77, lamp 72, second lamp terminal 81, contact 42, lamp housing 71, battery housing 26, switch bias spring 65, bent leaf spring 68 on slide 64, engaged switch contact 69, battery spring assembly 75 and other side or negative pole of the battery 28.

The lamp 72 is thus electrically energized and lit to emit the aim-assisting light beam 27.

The reflector assembly 73 is designed to provide a prefocused beam 27 giving a bright central spot 83 for aiming the firearm, and a lower light level beam 84 for general illumination of a target. By way of example, the light source 72 may be a gas-filled or high-pressure gas flashlight lamp powered by a lithium battery 28 to produce a narrow central beam 27 of high intensity, suitable for aiming, along with a broad background beam 84 of lesser intensity, providing general area illumination in the direction in which the firearm is aimed or pointed.

The reflector assembly 73 not only includes a reflector 86 into which the lamp 72 projects, but also a glass or lens 87 and a lens cap 88.

Elastomeric members or O-rings 91, 92 and 93 may be provided between the battery housing 26 and the lamp housing 71, between that lamp housing and the lens cap 88, and between the lens 87 and that lens cap, respectively, to seal the unit 10 against external influences and to safeguard its parts during continuous firing of the weapon 12.

The lamp 72 may be confined with an elastomeric sleeve 96 or other elastic member for retaining that lamp securely in place throughout repeated firings of the firearm. The member 96 may, for instance, support the lamp 72 elastically with respect to the lamp base 78 and reflector 86, and may in effect trap the lamp against movement out of its socket 78.

Figure 2:
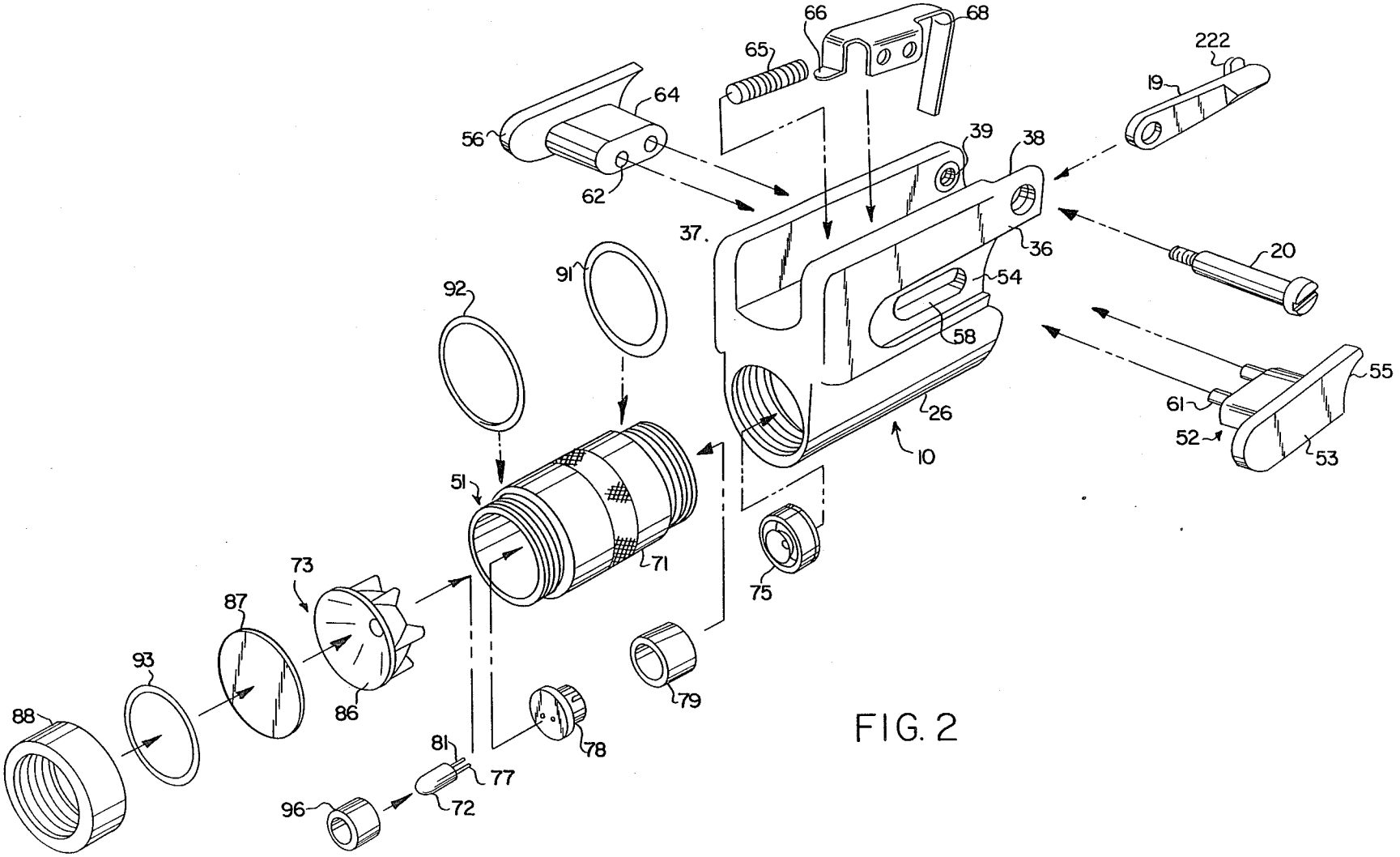
FIG. 2 is an exploded view, on an enlarged scale, of the apparatus shown in FIG. 1, with certain parts omitted for a better overall view.

As shown in FIG. 2, the slide stop 19 and its fastener 20 originally are separate parts, being brought together to attach the battery housing 26 to the firearm 12 or its frame 23 while attaching the slide stop or latch 19 at the same time to the firearm at the battery housing. As shown in FIG. 5, the shoulder screw 20 may in this manner act as a common fastener for attaching the slide stop or latch 19 in fact to the battery housing, while also attaching the battery housing to the firearm, according to an embodiment of the subject invention.

In this respect, attachment of the slide stop or latch 19 to the battery housing 26 in effect amounts to an attachment of that slide stop or latch to the firearm, to which the battery housing 26 is also attached by the common fastener 20.

Figure 6:
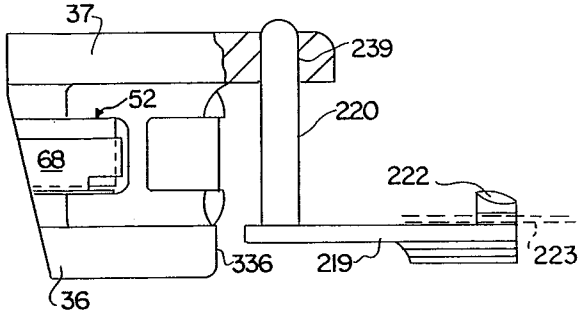
FIG. 6 is a detail view similar to FIG. 3 but showing a different latch.

According to the embodiment shown in FIG. 6, the necessary functional part 219 is or is made integral with the fastener 220. If desired, the battery housing extension 36 may be shortened as shown, by way of example, at 236 in FIG. 6.

In that embodiment shown in FIG. 6, the fastener 220 is still common to the battery housing 26 and to the functional part 219 necessary for the operation of the firearm 12 as a firearm. The slide stop or other necessary functional part 219 may be provided with a catch or latch 222 which, in a manner known per se, may slide under a thin part 223 of the firearm 12 in any active position thereof. In that case, the functional part 219 and the fastener 220 will releasably retain the battery housing 26 on the firearm, even without provision of a threaded bore for the common fastener 220. In that case, the battery housing extension 37 may be provided with a straight bore 239 for receiving an end of the common fastener 220.

For a removal of the aim assistance apparatus 10 from the firearm 12, any set screw present, such as those shown at 33, may be loosened and the slide stop 219 may be swung to a positon where the catch 222 clears the part 223 of the firearm, so that the common fastener 220 may be pulled out of the bore 239 in the battery housing extension 37 and out of the bore 44 in the firearm frame 23 by pulling the slide stop 219 outwardly. By reversing that process, the battery housing may thereafter be remounted on the firearm 12, such as in the position shown in FIG. 1.

Figure 7:
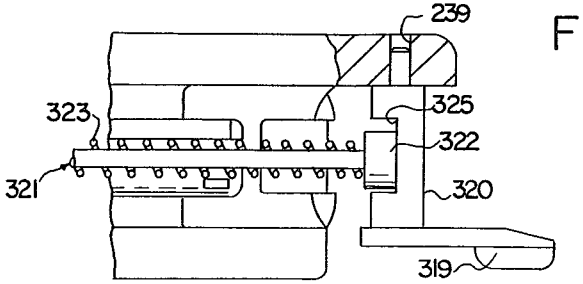
FIG. 7 is a detail view similar to FIGS. 3 and 6, but showing a special latch cooperating with a recoil spring and guide in retaining the apparatus according to another embodiment of the invention.

Another variation within an embodiment of the subject invention is illustrated in FIG. 7, according to which the one necessary part 319 is coupled through a common fastener 320 to another of the functional parts 321 necessary for the operation of the firearm as a firearm.

By way of example, the other or second necessary functional part may be a guide 322 for a recoil spring or may be that recoil spring 323 itself.

The fastener 320 common to the battery housing 26 carries a disassembling latch 319 which may be similar to the latches 19 and 219 shown in FIGS. 2 to 5 and 6. The common fastener 320 has a recess or notch 325 for accommodating a head of the recoil spring guide 322. By way of example, the parts 319, 320, 322 and 323 may be the disassembling latch, recoil spring guide and recoil spring of a Beretta 92 SB pistol.

In order to disassemble such a pistol, the disassembling latch 319 is released and rotated downwardly, as seen in FIG. 7, the slide barrel assembly of the pistol is then pulled forwardly with the recoil spring 323 and spring guide 322. The recoil spring and spring guide are then slightly pressed and are lifted out of the assembling, letting the recoil spring 323 stretch slowly. As is well known, the locking block plunger and the barrel locking assembly (not shown) may then be removed from the slide barrel assembly.

The disassembling latch 319 may also be removed by pulling it sideways out of the apertures 44 and 239 whereby the aim assistance apparatus 10 including the battery housing 26 may be removed from the firearm.

That aim assistance apparatus may thereafter be reattached to the firearm 12 by reinserting the common fasteners 20, 220 or 320 through the firearm aperture 44 into the battery housing aperture 39 or 239. Unintended removal of the aim assistance apparatus from the firearm is thereby inhibited by making the aperture threaded, as shown at 39 in FIGS. 2 to 5, by providing the slide stop 19 or 219 with a latch or catch 222 or by providing the common fastener 320 with a notch or recess 325 in which a portion of the other necessary functional part 321 will catch so as to avoid removal of the common fastener 320 from the battery housing and the firearm, until the latch 319 is rotated downwardly, as seen in FIG. 6. In that case, the common fastener 320 moves out of the way, allowing the slide 18 to be removed from the frame. The common fastener 320 can then be rotated and removed sideways.

The coupling means thus presented by the common fastener 320 may be integral with the latch 319, or such latch and common fastener may be made of one piece.

The features of the subject invention just disclosed with the aid of FIGS. 1 to 2 have general applicability to firearms other than the weapon shown in FIG. 1. By way of example, aim assistance apparatus embodying the principles of the subject invention may also be designed for or applied to revolvers, shotguns, automatic rifles, and the like.

Figure 8:
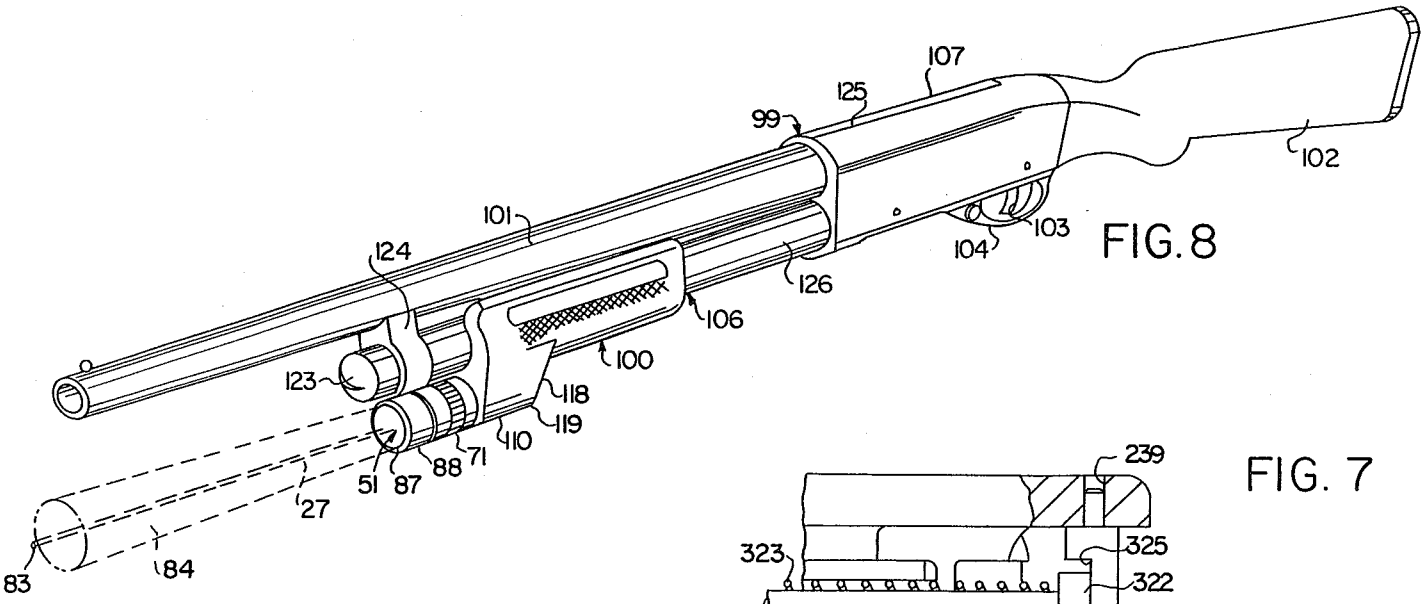
FIG. 8 is a perspective view of another firearm with apparatus for assisting the aiming thereof according to a further embodiment of the subject invention.

By way of example, FIG. 8 shows application of the principles of the subject invention to a different kind of firearm, such as a Model 870 Remington shotgun 99, equipped with an aim assistance apparatus 100 according to a further embodiment of the subject invention.

In similarity to the handgun 12, the shotgun 99 has a barrel 101, a stock 102, a trigger 103 and trigger guard 104. The shotgun 99 also has a movable fore-end assembly 106 for loading or ejecting shells and actuating a firearm action 107. That much is well known in the shotgun art.

Figures 9, 10:
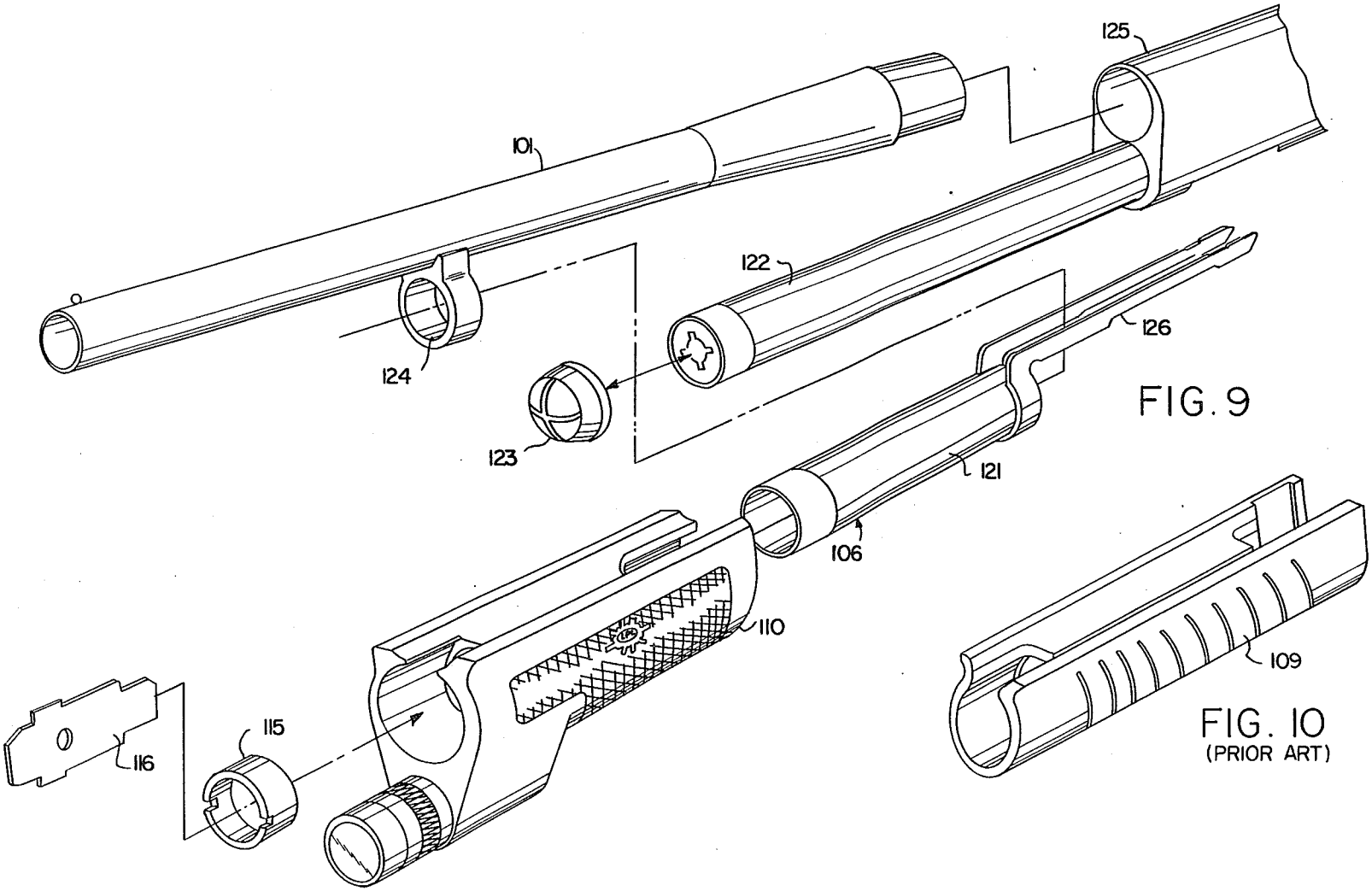
FIG. 10 (PRIOR ART)
FIG. 9 is an exploded view of parts of the firearm and aim assisting apparatus of FIG. 8.
FIG. 10 is an example of a conventional handgrip which is replaced by the apparatus shown in FIGS. 8 and 9.

It is also well known that such fore-end assemblies have handgrips for manual actuation of the fore-end assembly and firearm action. An example of such a conventional handgrip 109 suitable for the shotgun 99 is shown in FIG. 10. Ordinarily, when such a shotgun is purchased, the handgrip 109 is already mounted on the fore-end assembly as a functional part thereof.

According to the preferred embodiment of the invention illustrated in FIG. 8, the battery housing 110 of the aim assistance apparaus 100 is shaped and constituted as a handgrip for manual actuation of the fore-end assembly 106 and for reception of an electric battery remotely from the stock 102 of the firearm. Again, contrary to frequent prior-art approaches to the energization of aim assistance light sources, no modification of the gun stock 102 or of any other part of the weapon is necessary.

The accommodation of the battery in the unit 100 may in essence be the same as for the battery 28 shown for the unit 10 in FIG. 4. The lamp housing 71 and its contents and parts may also be the same for the units 10 and 100.

In principle, the unit 100 could be provided with a switch similar to the slide switch 52 shown in FIGS. 1 to 5, or with a touch-type switch (not shown) provided on a side of, or integral with, the battery housing 110.

According to the preferred embodiment of the subject invention illustrated in FIGS. 8 and 9, the battery housing 110 shaped and constituted as a handgrip is mounted on the fore-end assembly 106 in lieu of the standard handgrip 109, shown in FIG. 10. The battery housing 110 is so mounted on the fore-end assembly for manual actuation of that fore-end assembly and for reception of an electric battery remotely from the stock 102 of the firearm. As also shown at 51 in FIGS. 8 and 9, a light source is mounted on the battery housing 110 for providing the aim assistance light beam 27 upon energization from the battery through an electric on-off switch provided independently of a trigger and hammer assembly of the firearm.

According to the above mentioned principle of the subject invention, gunsmithing for attachment of the unit 100 or battery housing 110 to the shotgun 99 is again avoided. For instance, where the conventional handgrip 109 was attached to the fore-end assembly by a conventional fastener, such as a fore-end tube nut 115, that common fastener may again be employed for attaching the handgrip-shaped battery housing 110 to the fore-end assembly 106, such as with the aid of an installation tool or nut driver 116.

According to a related embodiment of the subject invention, the firearm 99 may be equipped with a hand guard 118 by providing at least part of the battery housing as a downward projection 119 as seen from the fore-end assembly 106, to stop any user's hand from slipping into the firing range of the firearm.

The latter feature is particularly important in the case of sawed-off shotguns or other weapons where the barrel end or muzzle is close to the front end of the fore-end assembly. In such cases, the marksman's hand sometimes slipped off the conventional handgrip, especially during repeated actuation of the movable fore-end assembly, with resulting injury to the marksman.

By providing the battery housing or aim assistance apparatus with the downward projection 119, the illustrated embodiment of the invention provides the marksman with a hand guard 118, keeping his or her fingers away from the projectiles shot from the barrel of the weapon.

The preferred embodiment of the invention illustrated in FIGS. 8 and 9 mounts the light source and lamp housing 51 on the downward projection 119 of the unit 100. In this respect, such downward projection may in effect be the battery housing, in which a battery 28 is contained in the manner illustrated in FIG. 4. The remainder of the component 110 may then constitute the handgrip for actuation of the movable fore-end assembly 106.

In the embodiment illustrated in FIGS. 8 and 9, the battery housing 110 is mounted with the common fastener 115 on the fore-end tube assembly 121 which, in turn, is located on the magazine tube 122 which has a magazine cap 123 for retaining the barrel 101 at the barrel lug 124 and in the receiver 125.

Action bars 126, projecting rearwardly from the tube 121, extend into the receiver 125 for carrying and activating the bolt (not shown) of the shotgun.

However, the scope of the subject invention is not limited to mechanical details. For instance, the same principles may be employed for mounting a lamp housing on carbines, machine guns or other weapons. For instance, where a firearm, such as the MP5 machine gun or the HK94 carbine, has a circular depression at the front of the receiver, a lamp housing of the type shown at 110 may be provided with a projecting tongue extending into the circular depression for retaining the battery housing in the manner of the standard handguard The common fastener in that case may be the handguard locking pin of the weapon.

These and other modificatons and variations within the scope and spirit of the subject invention will become apparent or suggest themselves to those skilled in the art from this extensive disclosure.

I claim:

1. In apparatus including a flashlight for throwing a light beam assisting the aiming of a firearm having a barrel, stock, trigger, trigger guard and hammer assembly, the improvement comprising in combination:

a lamp and reflector assembly for throwing said light beam upon electric energization of the lamp;

a battery housing having a contour adapted to a contour of said firearm below said barrel for mounting said light and reflector assembly below said barrel ahead of the trigger guard as seen in a direction of said light beam, including a rear end remote from said lamp assembly and contoured into conformity to an adjacent portion of said trigger guard spaced away from said trigger;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch, including a lamp housing containing said lamp and reflector assembly and being releasably mounted on said battery housing for receiving a part of said electric battery protruding from said battery housing;

means for manual actuation of said switch including a manually engageable switch actuator spaced away from the trigger; and means for mounting said battery housing on said firearm below said barrel, including a fastener common to said battery housing and to a functional part necessary for the operation of said firearm as a firearm.

2. Apparatus as claimed in claim 1, wherein:

said means for mounting the battery housing include a housing mount contoured into conformity with a lower portion of said firearm below said barrel.

3. Apparatus as claimed in claim 2, including:

means for biasing said electric on-off switch to its off position so that said electric energization of the lamp only persists as long as said switch actuator is manually engaged in an on position.

4. Apparatus as claimed in claim 2, wherein:

said manually engageable switch actuator is mounted on one side of said battery housing; and said switch includes a corresponding further manually engageable switch actuator for ambidextrous operation of said switch.

5. In apparatus including a flashlight for throwing a light beam assisting the aiming of a firearm having a barrel, stock, trigger, trigger guard and hammer assembly, the improvement comprising in combination:

a lamp and reflector assembly for throwing said light beam upon electric energization of the lamp;

a battery housing having contour adapted to a contour of said firearm below said barrel for mounting said light and reflector assembly below said barrel ahead of the trigger guard seen in a direction of said light beam;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch;

means for manual actuation of said switch including a manually engageable switch actuator spaced away from the trigger and including a manually engageable slide element substantially flush with an outside surface of the battery housing at one side of said battery housing; and means for mounting said battery housing on said firearm below said barrel, including a fastener common to said battery housing and to a functional part necessary for the operation of said firearm as a firearm.

6. Apparatus as claimed in claim 5, wherein:

said switch includes a corresponding further manually engageable slide element substantially flush with a further outside surface of the battery housing at an opposite side of the battery housing.

7. In apparatus including a flashlight for throwing a light beam assisting the aiming of a firearm having a barrel, stock, trigger, trigger guard and hammer assembly, the improvement comprising in combination:

a lamp and reflector assembly for throwing said light beam upon electric energization of the lamp;

a battery housing having a contour adapted to a contour of said firearm below said barrel for mounting said light and reflector assembly below said barrel ahead of the trigger guard as seen in a direction of said light beam including a rear end remote from said lamp assembly and contoured into conformity to an adjacent portion of said trigger guard spaced away from said trigger;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch;

means for manual actuation of said switch including a manually engageable switch actuator spaced away from the trigger; and means for mounting said battery housing on said firearm below said barrel, including a fastener common to said battery housing and to a functional part necessary for the operation of said firearm as a firearm.

8. Apparatus as claimed in claim 7, wherein:

said means for mounting the battery housing include a housing mount contoured into conformity with a lower portion of said firearm below said barrel.

9. Apparatus as claimed in claim 7, wherein:

said functional part is a slide stop necessary for selectively arresting and releasing said slide; and said common fastener attaches both said battery housing and said slide stop to said firearm.

10. Apparatus as claimed in claim 7, including:

means including an elastic member for retaining said lamp securely in place throughout repeated firings of said firearm.

11. Apparatus as claimed in claim 7, wherein:

said necessary functional part is integral with said fastener.

12. In apparatus including a flashlight for throwing a light beam assisting the aiming of a firearm having a barrel, stock, trigger, trigger guard and hammer assembly, the improvement comprising in combination:

a lamp and reflector assembly for throwing said light beam upon electric energization of the lamp;

a battery housing having a contour adapted to a contour of said firearm below said barrel for mounting said light and reflector assembly below said barrel ahead of the trigger guard as seen in a direction of said light beam;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch;

means for manual actuation of said switch including a manually engageable switch actuator spaced away from the trigger;

means for mounting said battery housing on said firearm below said barrel, including a fastener common to said battery housing and to a functional part located above said finger guard and necessary for the operation of said firearm as a firearm; and said means for mounting the battery housing include a housing mount extending to the location of said necessary functional part above said trigger guard so that both said battery housing at said housing mount and said one necessary functional part are attachable to said firearm with said common fastener.

13. In apparatus including a flashlight for throwing a light beam assisting the aiming of a firearm having a barrel, stock, trigger, trigger guard and hammer assembly, the improvement comprising in combination:

a lamp and reflector assembly for throwing said light beam upon electric energization of the lamp including means for providing a prefocused beam giving a bright central spot for aiming said firearm, and a lower light level beam for general illumination of a target;

a battery housing having a contour adapted to a contour of said firearm below said barrel for mounting said light and reflector assembly below said barrel ahead of the trigger guard as seen in a direction of said light beam;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch;

means for manual actuation of said switch including a manually engageable switch actuator spaced away from the trigger; and means for mounting said battery housing on said firearm below said barrel, including a fastener common to said battery housing and to functional part necessary for the operation of said firearm as a firearm.

14. In apparatus including a flashlight for throwing a light beam assisting the aiming of a firearm having a barrel, stock, trigger, trigger guard and hammer assembly, the improvement comprising in combination a lamp and reflector assembly for throwing said light beam upon electric energization of the lamp;

a battery housing having a contour adapted to a contour of said firearm below said barrel for mounting said light and reflector assembly below said barrel ahead of the trigger guard as seen in a direction of said light beam, including a rear end remote from said lamp assembly and contoured into conformity to an adjacent portion of said trigger guard spaced away from said trigger;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch, including a lamp housing containing said lamp and reflector assembly and being releasably mounted on said battery housing for receiving a part of said electric battery protruding from said battery housing;

means for manual actuation of said switch including a manually engageable switch actuator spaced away from the trigger; and means for mounting said battery housing on said firearm below said barrel, including a fastener common to said battery housing and to a functional part necessary for the operation of said firearm as a firearm;

said necessary functional part and said fastener being in one piece.

15. In apparatus including a flashlight for throwing a light beam assisting the aiming of a firearm having a barrel, stock, trigger, trigger guard and hammer assembly, the improvement comprising in combination:

a lamp and reflector assembly for throwing said light beam upon electric energization of the lamp;

a battery housing having a contour adapted to a contour of said firearm below said barrel for mounting said light and reflector assembly below said barrel ahead of the trigger guard as seen in a direction of said light beam, including a rear end remote from said lamp assembly and contoured into conformity to an adjacent portion of said trigger guard spaced away from said trigger;

an electric circuit for selectively energizing said lamp from an electric battery, including an electric on-off switch independent of said trigger and hammer assembly;

means in said battery housing for receiving said electric battery remotely from said stock and for providing said electric energization of the lamp upon closure of said switch, including a lamp housing containing said lamp and reflector assembly and being releasably mounted on said battery housing for receiving a part of said electric battery protruding from said battery housing;

means for manual actuation of said switch including a manually engageable switch actuator spaced away from the trigger; and means for mounting said battery housing on said firearm below said barrel, including a fastener common to said battery housing and to a functional part necessary for the operation of said firearm as a firearm;

said fastener including means for coupling said necessary functional part to another functional part necessary for the operation of said firearm.

16. Apparatus as claimed in claim 15 wherein:

said coupling means are integral with said fastener and said necessary functional part.

17. In a method of providing an aim assistance light beam for a firearm having functional parts necessary for the operation of said firearm as a fiream, the improvement comprising in combination the steps of:

adapting a battery housing to a contour of said firearm below a barrel and ahead of a trigger guard thereof as seen in a direction of said light beam, for reception of an electric battery remotely from a stock of said firearm;

providing a common fastener for said battery housing as well as for one of said necessary functional parts of firearm;

attaching with said common fastener both said battery housing below said barrel at said contour and said one necessary functional part to said firearm;

mounting on said battery housing a light source for providing said aim assistance light beam upon energization from said battery through an electric on-off switch provided independently of any trigger and hammer assembly of said firearm; and mounting said on-off switch on said battery housing at said trigger guard and spaced away from said trigger.

18. A method a claimed in claim 17, including the steps of:

providing said light source with a lamp housing releasably mountable on said battery housing and shaping said lamp housing for receiving a part of said electric battery protruding from said battery housing.

19. A method as claimed in claim 18, including the steps of:

providing an elastic coupling between said light source and said lamp housing; and retaining said light source securely in said lamp housing with said elastic coupling throughtout repeated firings of said firearm.

20. A method as claimed in claim 17, including the step of:

making said fastener integral with said one necessary functional part.

21. In a method of providing an aim assistance light beam for a firearm having functional parts necessary for the operation of said firearm as a firearm, the improvement comprising in combination the steps of:

adapting a battery housing to a contour of said firearm below a barrel and ahead of a trigger guard thereof as seen in a direction of said light beam, for reception of an electric battery remotely from a stock of said firearm;

providing a common fastener for said battery housing as well as for one of said necessary functional parts of the firearm;

attaching with said common fastener both said battery housing at said contour and said one necessary functional part to said firearm;

mounting on said battery housing a light source for providing said aim assistance light beam upon energization from said battery through an electric on-off switch provided independently of any trigger and hammer assembly of said firearm; and providing with said light source a prefocused beam giving a bright central spot for aiming said firearm, and a lower light level beam for general illumination of a target.

22. In a method of providing an aim assistance light beam for a firearm having functional parts necessary for the operation of said firearm as a firearm, the improvements comprising in combination the steps of:

situating one of said necessary functional parts above said trigger guard;

adapting a battery housing to a contour of said firearm below a barrel and ahead of a trigger guard thereof as seen in a direction of said light beam, for reception of an electric battery remotely from a stock of said firearm;

providing a common fastener for said battery housing as well as for one of said necessary functional parts of the firearm; and providing said battery housing with an extension reaching said necessary functional part so that both said battery housing at said extension and said one necessary functional part are attachable to said firearm with said common fastener;

attaching with said common fastener both said battery housing at said contour and said one necessary functional part to said firearm; and mounting on said battery housing a light source for provhding said aim assistance light beam upon energization from said battery through an electric on-off switch provided independently of any trigger and hammer assembly of said firearm.

23. In a method of providing an aim assistance light beam for a firearm having functional parts necessary for the operation of said firearm as a firearm including a slide and a slide stop necessary for selectively arresting and releasing said slide, the improvement comprising in combination the steps of:

adapting a battery housing to a contour of said firearm below a barrel and ahead of a trigger guard thereof as seen in a direction of said light beam, for reception of an electric battery remotely from a stock of said firearm;

providing a common fastener-for said battery housing as well as for said slide stop;

attaching with said comon fastener both said battery housing at said contour and said slide stop to said firearm; and mounting on said battery housing a light source for providing said aim assistance light beam upon energization from said battery through an electric on-off switch provided independently of any trigger and hammer assembly of said firearm.

24. In a method of providing an aim assistance light beam for a firearm having functional parts necessary for the operation of said firearm as a firearm, the improvement comprising in combination the steps of:

adapting a battery housing to a contour of said firearm below a barrel and ahead of a trigger guard thereof as seen in a direction of said light beam, for reception of an electric battery remotely from a stock of said firearm;

providing a common fastener for said battery housing as well as for one of said necessary functional parts of the frearm and making said fastener and said one necessary functional part in one piece;

attaching with said common fastener both said battery housing at said contour and said one necessary functional part to said firearm; and mounting on said battery housing a ligh source for providng said aim assistance light beam upon energization from said battery through an electric on-off switch provided independently of any trigger and hammer assembly of said firearm.

25. In a method of providing an aim assistance light beam for a firearm having functional parts necessary for the operation of said firearm as a firearm, the improvement comprising in combination the steps of:

adapting a battery housing to a contour of said firearm below a barrel and ahead of a trigger guard thereof as seen in a direction of said light beam, for reception of an electric battery remotely from a stock of said firearm;

providing a common fastener for said battery housing as well as for one of said necessary functional parts of the firearm;

coupling said one necessary functional part through said fastener to another of said functional parts necessary for the operation of said firearm;

attaching both said battery housing at said contour and said one necessary funtional part to said firearm with said fastener coupling said one necessary functional part to said other functional part necessary for the operation of said firearm; and mounting on said battery housing a light source for providing said aim assistance light beam upon energization from said battery through an electric on-off switch provided independently of any trigger and hammer assembly of said firearm.

* * * * *